US010539059B2

(12) United States Patent
Bugnell et al.

(10) Patent No.: US 10,539,059 B2
(45) Date of Patent: Jan. 21, 2020

(54) MIXER FOR AN EXHAUST SYSTEM

(71) Applicant: Eberspächer North America Inc., Novi, MI (US)

(72) Inventors: Mark Dennis Bugnell, South Lyon, MI (US); John Francis Padalis, Belleville, MI (US); Jack Hall Riddle, II, Brighton, MI (US); Timothy Edward Fensch, Allen Park, MI (US)

(73) Assignee: Eberspächer North America Inc., Novi, MI (US)

( * ) Notice: Subject to any disclaimer, the term of this patent is extended or adjusted under 35 U.S.C. 154(b) by 430 days.

(21) Appl. No.: 15/263,992

(22) Filed: Sep. 13, 2016

(65) Prior Publication Data

US 2018/0073411 A1 Mar. 15, 2018

(51) Int. Cl.

| | |
|---|---|
| ***F01N 3/28*** | (2006.01) |
| ***B21D 53/84*** | (2006.01) |
| ***F01N 3/20*** | (2006.01) |

(52) U.S. Cl.

CPC ..... *F01N 3/2892* (2013.01); *B21D 53/84* (2013.01); *F01N 3/2066* (2013.01)

(58) Field of Classification Search

CPC .. F01N 3/2892; F01N 3/2066; F01N 2240/20; B21D 53/84

USPC ..... 60/299, 324

See application file for complete search history.

(56) References Cited

U.S. PATENT DOCUMENTS

2008/0308083 A1 12/2008 Wirth et al.
2015/0267587 A1* 9/2015 Calvo ..... F01N 3/2066 60/301

FOREIGN PATENT DOCUMENTS

| | | | |
|---|---|---|---|
| DE | 10 2007 028 449 | A1 | 10/2008 |
| DE | 10 2012 218740 | A1 | 4/2013 |
| EP | 2 022 956 | A2 | 2/2009 |
| EP | 2 278 133 | A2 | 1/2011 |

* cited by examiner

*Primary Examiner* — Phutthiwat Wongwian
*Assistant Examiner* — Kelsey L Stanek
(74) *Attorney, Agent, or Firm* — McGlew and Tuttle, P.C.

(57) ABSTRACT

A mixer for an exhaust system of an internal combustion engine, for mixing a reactant with an exhaust gas flow, includes guide blade portions, fold webs and spacer webs. The guide blade portions are provided as guide blade pairs including a first blade portion connected to a second guide blade portion by at least one of the fold webs and folded at the at least one of the fold webs such that the first blade portion is disposed extending adjacent to and spaced from the second guide blade portion. Each of the guide blade pairs is connected to at least one adjacent guide blade pair by at least one of the spacer webs. The fold webs are disposed centrally and located adjacent to each other in an annular pattern of adjacent fold webs and the spacer webs are disposed peripherally spaced apart from each other about a circumference of the mixer.

10 Claims, 15 Drawing Sheets

MIXER FOR AN EXHAUST SYSTEM

FIELD OF THE INVENTION

The present invention pertains to a mixer for an exhaust system of an internal combustion engine for mixing a reactant with an exhaust gas flow with a pipe section, which borders a flow cross section, through which the exhaust gas flow can flow, in a circumferential direction, and which extends in an axial direction from a first axial side of the pipe section to a second axial side of the pipe section and with a plurality of guide blades, which project from the pipe section at least on one of the axial sides such that they protrude into the flow cross section. The present invention pertains, moreover, to a reactant feeding device for an exhaust system of an internal combustion engine, which is equipped with such a mixer. Finally, the present invention pertains to an exhaust system for an internal combustion engine, which is equipped with such a reactant feeding device.

BACKGROUND OF THE INVENTION

It is often necessary in exhaust systems of internal combustion engines to introduce a reactant, i.e., preferably a hydrocarbon or a reducing agent, into the exhaust gas flow. For example, a fuel may be introduced upstream of an oxidation catalytic converter in order to increase the heat in the exhaust gas flow by a catalytic reaction of the fuel in the oxidation catalytic converter. For example, a particle filter can be heated in this manner to a regeneration temperature. Further, it is known in connection with so-called SCR systems that an aqueous urea solution may be introduced as a reducing agent into the exhaust gas flow upstream of an SCR catalytic converter in order to bring about a reduction of nitrogen oxides in the SCR catalytic converter. SCR denotes Selective Catalytic Reduction. The mixing of the reactant introduced with the exhaust gas flow can be improved by means of such a mixer. In addition, the mixer may act as an evaporator and prevent liquid reactant from reaching the respective catalytic converter in case of liquid reactants.

A mixer for an exhaust system of an internal combustion engine, which is used to mix and evaporate a reducing agent with an exhaust gas flow, is known from US 2008/0308083 (DE 10 2007 028 449 A1). The mixer has for this purpose a pipe section, which borders a flow cross section, through which the exhaust gas flow can flow, in a circumferential direction, and which extends in an axial direction from a first or incoming flow-side axial side of the pipe section to a second or discharge-side axial side of the pipe section. The pipe section comprises a plurality of guide blades, which project from the pipe section on one of the axial sides, doing so such that they protrude into the flow cross section.

SUMMARY OF THE INVENTION

It is an object of the present invention to provide an improved embodiment, which is characterized especially by a reduced flow resistance and/or by improved mixing between the reactant and the exhaust gas flow, for a mixer of the type described in the introduction or for a reactant feeding device equipped therewith or for an exhaust system equipped therewith.

According to the invention, a mixer is provided for an exhaust system of an internal combustion engine, for mixing a reactant with an exhaust gas flow. The mixer comprises a plurality of guide blade portions, fold webs and spacer webs.

The guide blade portions are provided as guide blade pairs comprising a first blade portion connected to a second guide blade portion by at least one of the fold webs and folded at the at least one of the fold webs such that the first blade portion is disposed extending adjacent to and spaced from the second guide blade portion. Each of the guide blade pairs is connected to at least one adjacent guide blade pair by at least one of the spacer webs. The fold webs are disposed centrally and located adjacent to each other in an annular pattern of adjacent fold webs and the spacer webs are disposed peripherally spaced apart from each other about a circumference of the mixer.

The guide blade portions, the fold webs and the spacer webs may be formed from a single integral flat blank. The guide blade pairs, comprising the first blade portion connected to the second guide blade portion by the at least one of the fold webs, may be separated from adjacent guide blade pairs by one of the spacer webs.

Each of the guide blade portions has a trailing edge axially spaced from a leading edge. The trailing edge is adjacent to a trailing surface extending at a pitch angle relative to a leading surface adjacent to the leading edge.

The guide blade pairs of the integral flat blank may be acted on with a forming process or by stamping to bend guide blade pairs to curve each trailing surface of the guide blade pairs to provide the pitch angle. The guide blade pairs may subsequently be folded at the at least one of the fold webs such that the first blade portion is disposed extending adjacent to the second guide blade portion. The curve of the trailing surface of the first blade portion may be different from or may essentially follow the curve of the trailing surface of the second guide blade portion.

Subsequent to folding the guide blade pairs, the folded guide blade pairs may be rolled to form the annular pattern of adjacent fold webs. The fold webs may each abut an adjacent fold web at one side and may abut an adjacent fold web at another side to form the annular pattern as a pattern of abutting fold webs.

The spacer webs may be connected to one of the first blade portions of one guide blade pair adjacent to the leading edge thereof and may be connected to one of the second blade portions of another guide blade pair adjacent to the leading edge thereof. The spacer webs may form an outer peripheral pipe contact surface for engaging an inner surface of an exhaust pipe.

The pitch angle of the trailing surface relative to the leading surface of the first blade portion of the guide blade pairs may be different from or essentially the same as the angle of the trailing surface relative to the leading surface of the second blade portion of the guide blade pairs. The trailing edges may be axially spaced from each respective leading edge to define a blade portion axial length. The axial lengths may be different or the axial length of the first blade portion of the guide blade pairs may essentially be the same as the axial length of the second blade portion of the guide blade pairs.

According to another aspect of the invention, a reactant feeding device for an exhaust system of an internal combustion engine is provided. The reactant feeding device comprises a pipe arrangement for guiding an exhaust gas flow, an injector arranged at the pipe arrangement for generating a spray jet from reactant for introduction of the reactant into the exhaust gas flow and a mixer arranged in the pipe arrangement downstream of the injector in relation of the exhaust gas flow. The mixer is as described herein.

According to another aspect of the invention a method of forming a mixer is provided for an exhaust system of an internal combustion engine for mixing a reactant with an exhaust gas flow. The method comprises providing a single integral sheet metal blank comprising a plurality of guide blade portions, fold webs and the spacer webs. The guide blade portions are provided as guide blade pairs comprising a first blade portion connected to a second guide blade portion by at least one of the fold webs with each of the guide blade pairs connected to at least one adjacent guide blade pair by at least one of the spacer webs. The guide blade pairs are folded or bent (curved) at the fold webs such that the first blade portion is disposed extending adjacent to the second guide blade portion. The folded guide blade pairs are rolled such that fold webs are disposed centrally and located adjacent to each other in an annular pattern of adjacent fold webs and the spacer webs are disposed peripherally spaced apart from each other about a circumference of the mixer.

The method may further include forming or stamping the guide blade portions to bend the guide blades to curve trailing surfaces of the guide blades to provide each guide blade with a pitch angle. The guide blade pairs may subsequently be folded at the at least one of the fold webs such that the first blade portion is disposed extending adjacent to the second guide blade portion. The guide blade portions of each guide blade pair may be acted on together by twisting forming or stamping to bend the guide blades relative to leading edges thereof, prior to the step of folding.

The spacer webs may be connected to one of the first blade portions of one guide blade pair adjacent to the leading edge thereof and connected to one of the second blade portions of another guide blade pair adjacent to the leading edge thereof. The spacer webs may form an outer peripheral pipe contact surface. The outer peripheral pipe contact surface may be connected to an inner surface of an exhaust pipe.

It is apparent that the above-mentioned features, which will also be explained below, may be used not only in the particular combination indicated, but in other combinations or alone as well, without going beyond the scope of the present invention.

Preferred exemplary embodiments of the present invention are shown in the drawings and will be explained in more detail in the following description, in which identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
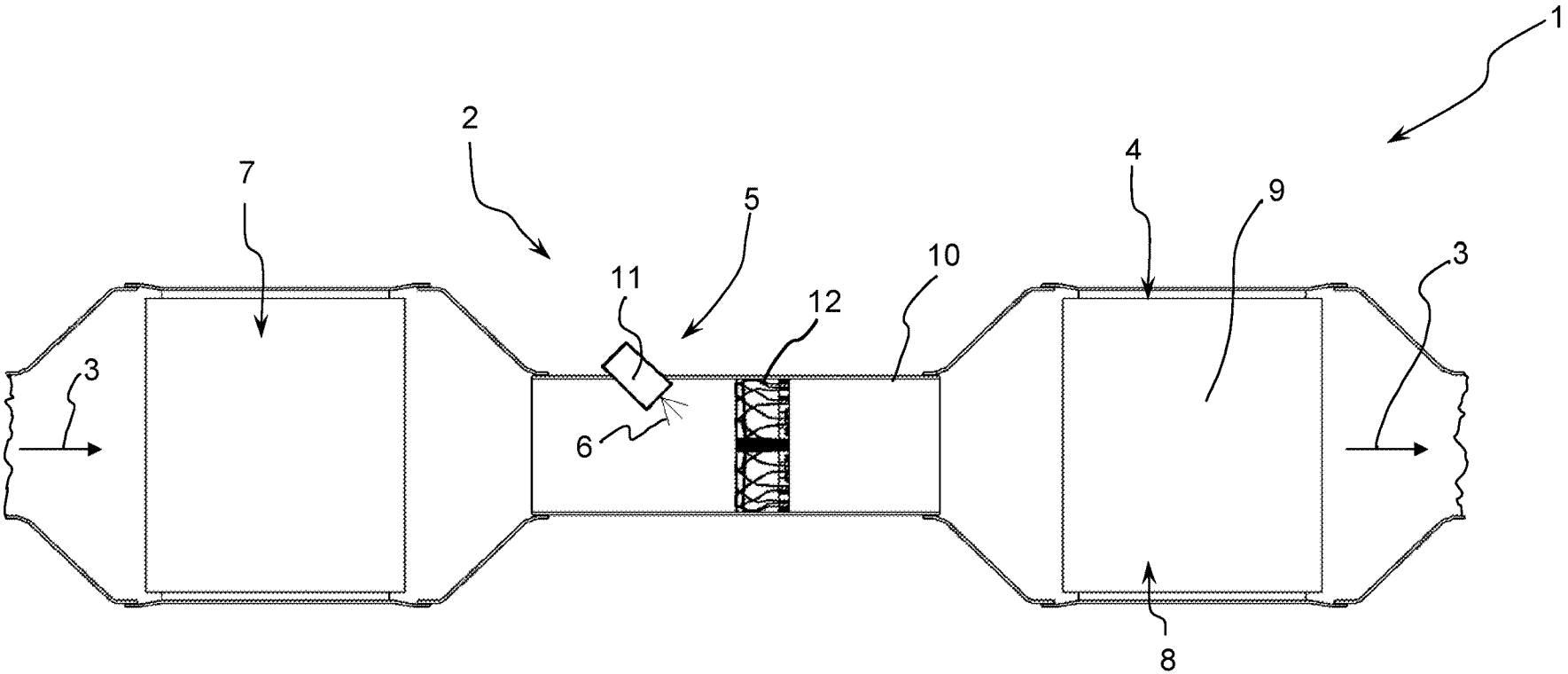
FIG. 1 is a highly simplified, circuit schematic diagram of an exhaust system with a reactant injection device which has a mixer according to the invention.
Figure 2:
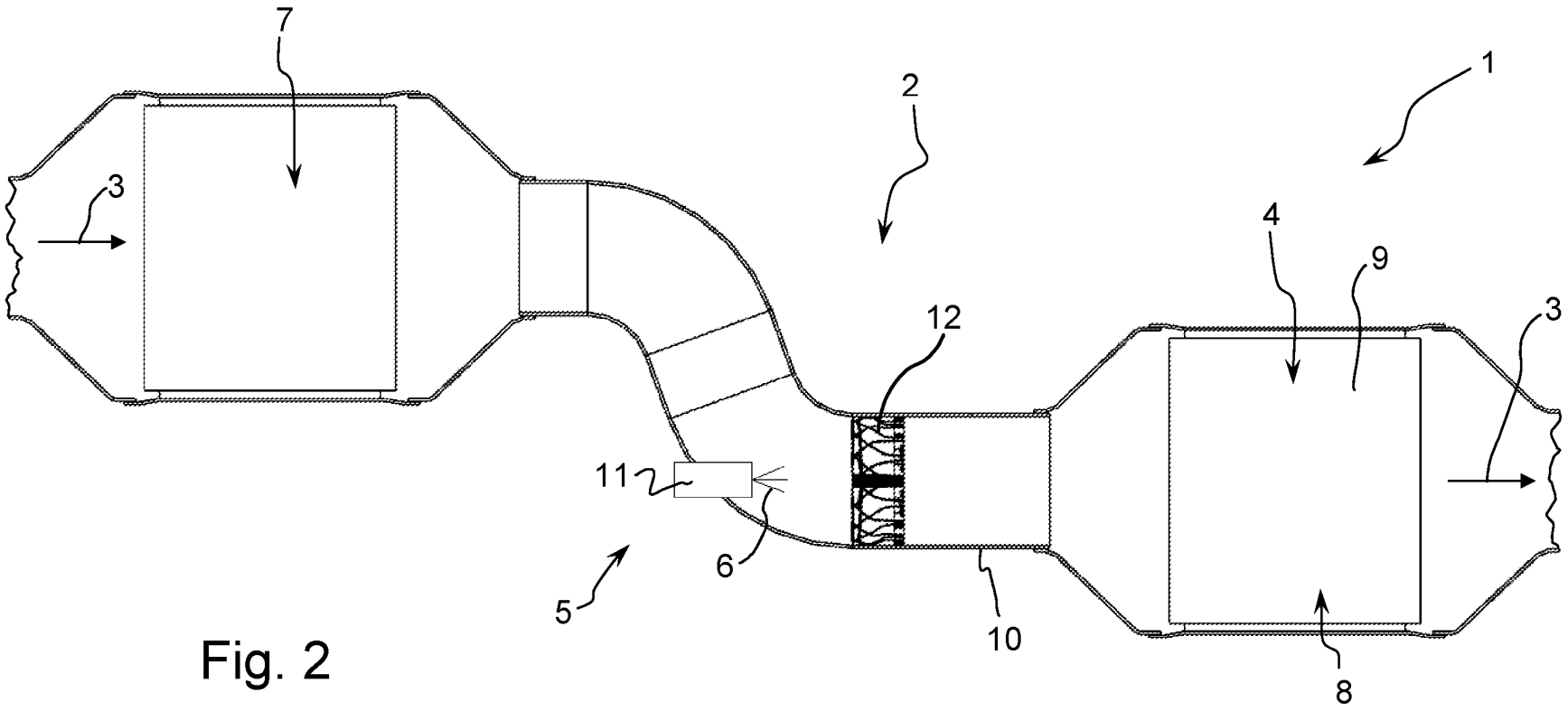
FIG. 2 is a schematic view of an exhaust system as shown in FIG. 1, but in another embodiment with a mixer according to the invention.

Referring to the drawings, corresponding to FIGS. 1 and 2, an exhaust system generally designated 1, shown only partially, is used to remove combustion waste gases in an internal combustion engine. The exhaust system 1 comprises an exhaust line generally designated 2 for guiding an exhaust gas flow indicated by arrows 3. An SCR catalytic converter generally designated 4 is arranged in the exhaust line 2. A reactant feeding device generally designated 5 is arranged in the exhaust line 2 upstream of the SCR catalytic converter 4. A reactant, for example, delivered in the form of a spray jet 6, can be fed into the exhaust gas flow 3 via the reactant feeding device 5. A reducing agent may be used as the reactant in connection with such an SCR catalytic converter 4. Nitrogen oxides can be reduced by means of the reducing agent in the SCR catalytic converter. In the example, the exhaust line 2 comprises, upstream of the reactant feeding device 5, an oxidation catalytic converter 7, which is preferably a diesel oxidation catalytic converter or a diesel particulate filter. Downstream of the reactant feeding device 5, the exhaust line 2 may contain a particle (particulate) filter generally designated 8, which is especially a diesel particle filter. The particle filter 8 may be arranged, downstream of the SCR catalytic converter 4. The SCR catalytic converter 4 and the particle filter 8 form separate components in this case. However, FIGS. 1 and 2 show embodiments, in which the SCR catalytic converter 4 is formed by an SCR catalytic converter coating, with which the particle filter 8 is provided. The particle filter 8 has, for example, a ceramic filter body, which has a plurality of inlet ducts, which are closed on the outlet side, and a plurality of outlet ducts, which are closed on the inlet side, wherein partitions, which separate the inlet ducts from the outlet ducts, are permeable to the exhaust gas flow 3, whereas they are essentially impermeable to the particles being entrained. The inlet ducts and/or the outlet ducts may be provided with said SCR catalytic converter coating 9, as a result of which the function of the SCR catalytic converter 4 is integrated in the particle filter 8.

Corresponding to FIGS. 1 and 2, the reactant feeding device 5 comprises a pipe arrangement 10, which is integrated into the exhaust line 2 and which is correspondingly likewise used to guide the exhaust gas flow 3. Further, the reactant feeding device 5 comprises an injector 11 for generating the spray jet 6 from reactant in order to introduce the reactant into the gas flow 3. The injector 11 is arranged for this on or adjacent to the pipe arrangement 10. The reactant feeding device 5 comprises, moreover, a mixer 12, which is arranged downstream of the injector 11 in the pipe arrangement 10 in relation to the exhaust gas flow 3. The mixer 12 is a separate component in relation to the pipe arrangement 10. The mixer 12 is inserted into the pipe arrangement 10 and the mixer 12 is fastened to the pipe arrangement 10 in a suitable manner.

Preferred embodiments of the mixer 12 will be described in more detail below on the basis of FIGS. 3 through 18. The mixer 12 comprises a plurality of guide blade portions 22 that are provided in guide blade pairs 28. Each of the guide blade pairs 28 includes a first guide blade portion 22 connected to a second guide blade portion 22 by at least one fold web 24. In the embodiments shown, two fold webs 24 connect one (first) guide blade portion 22 to another (second) guide blade portion 22 for each of the guide blade pairs 28. The guide blade pairs 28 are connected to each other by at least one spacer web 26. In the embodiments shown, one spacer web 26 connects adjacent guide blade pairs 28.

Figure 3:
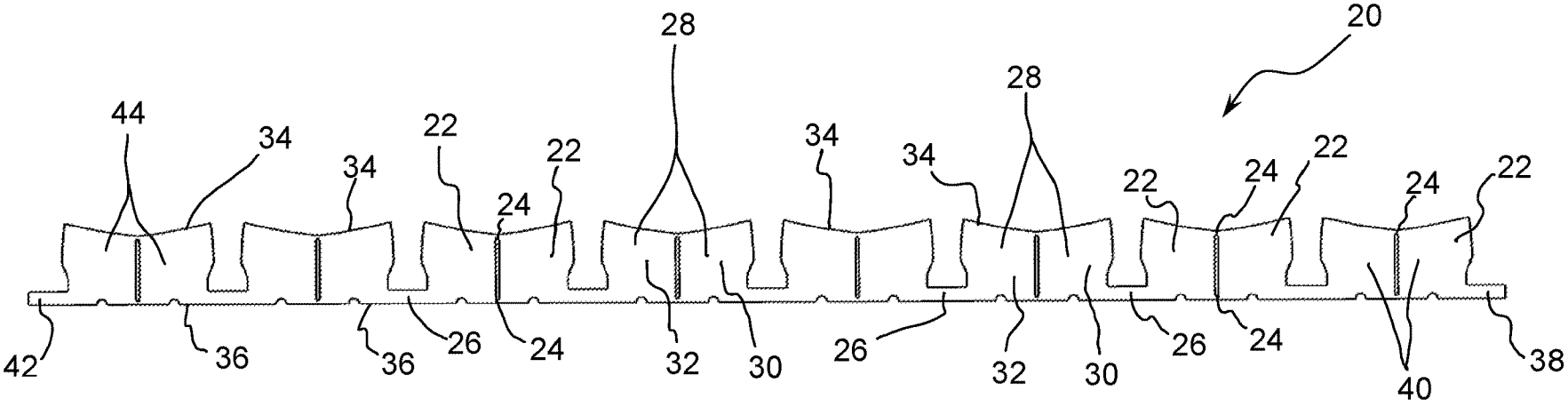
FIG. 3 is side plan view of a sheet metal blank.

The mixer is advantageously formed from a single integral flat blank (a sheet metal blank generally designated 20—FIG. 3). The flat blank 20 is punched from sheet steel or may be laser cut or otherwise provided from sheet metal. The flat blank 20 includes the guide blade portions 22, fold webs 24 and spacer webs 26. Each of the guide blade pairs 28 is connected to at least one adjacent guide blade pair 28 by at least one of the spacer webs 26. In the embodiments shown, eight guide blade pairs 28 are provided with seven spacer webs 26 between respective adjacent guide blade pairs 28. A first end spacer web segment 38 is at a first end of the flat blank 20, adjacent to a first end guide blade pair 40 and a second end spacer web segment 42 is at a second end of the flat blank 20, adjacent to second end guide blade pair 44.

Figure 8:
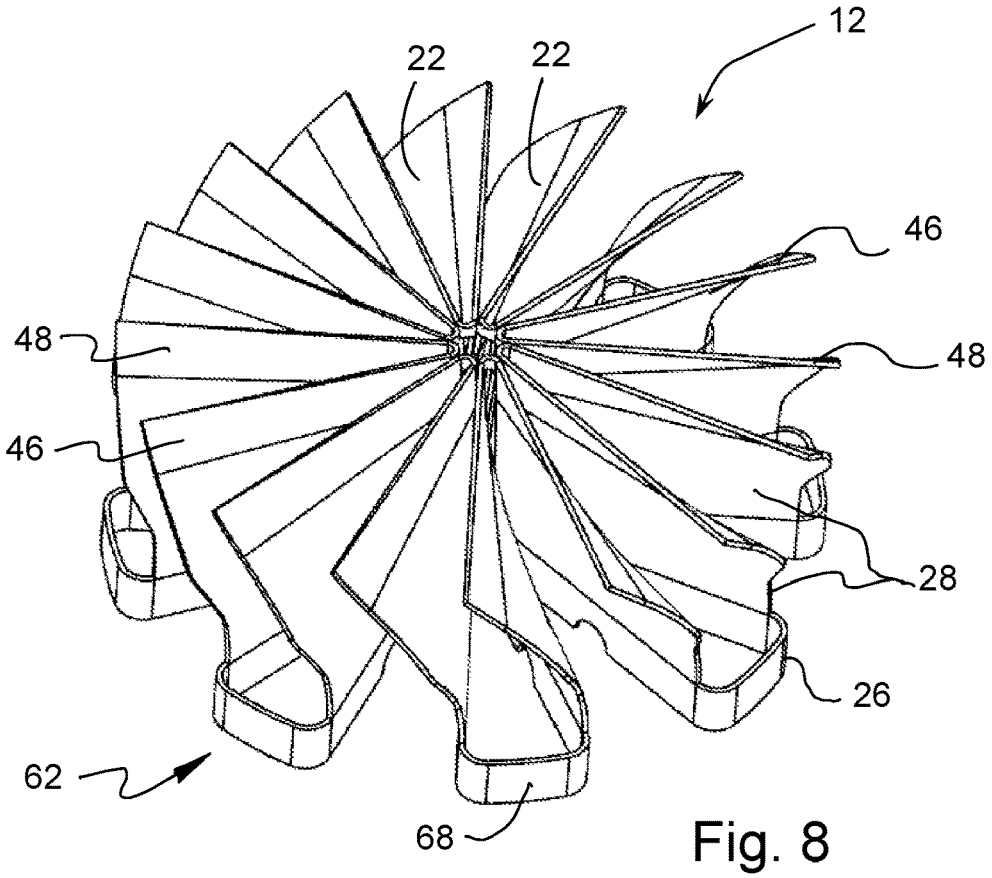
FIG. 8 is a perspective view showing the rolled blade pairs forming the shape of the final mixer.
Figure 9:
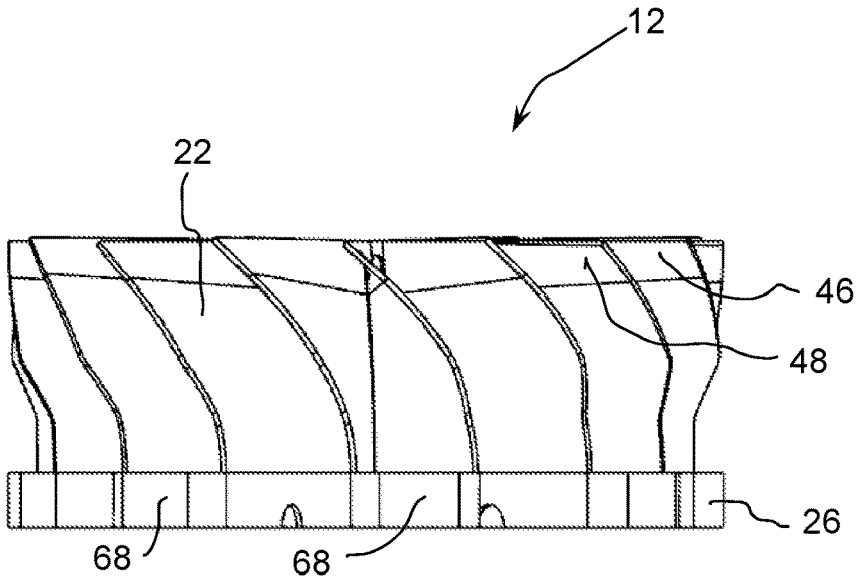
FIG. 9 is a side view of the mixer of FIG. 8.

The mixer 12 is formed from the flat blank 20. The method of forming comprises providing the single integral sheet metal blank 20 with the plurality of guide blade portions 22, the fold webs 24 and the spacer webs 26. Preferably, the guide blade portions 22 are shaped in a forming process such that each of the guide blade portions 22 has other than a flat shape. However, some or all of the guide blade portions 22 may have a flat extent from a guide blade leading edge 36 to a guide blade trailing edge 34. Advantageously, the trailing edge 34, which is axially spaced from the leading edge 36, may have a tailing surface that is at an angle relative to the blade surface proximate to the leading edge 36, to provide a pitch angle. This may promote better mixing. This tailing surface may be flat and the pitch angle may be formed simply by bending the trailing surface relative to the flat leading surface—relative to the blade surface proximate to the leading edge. The tailing surface or the entire blade may also be bent or curved. Further the bend or curve of the blade surfaces of the same blade pair 28 may be the same or different. In particular, the first portion curved or angled trailing surface 46 of the same blade pair 28 may have essentially the same curved surface as the second portion curved or angled trailing surface 48 of that same blade pair 28 (FIGS. 8 and 9).

Figure 4:
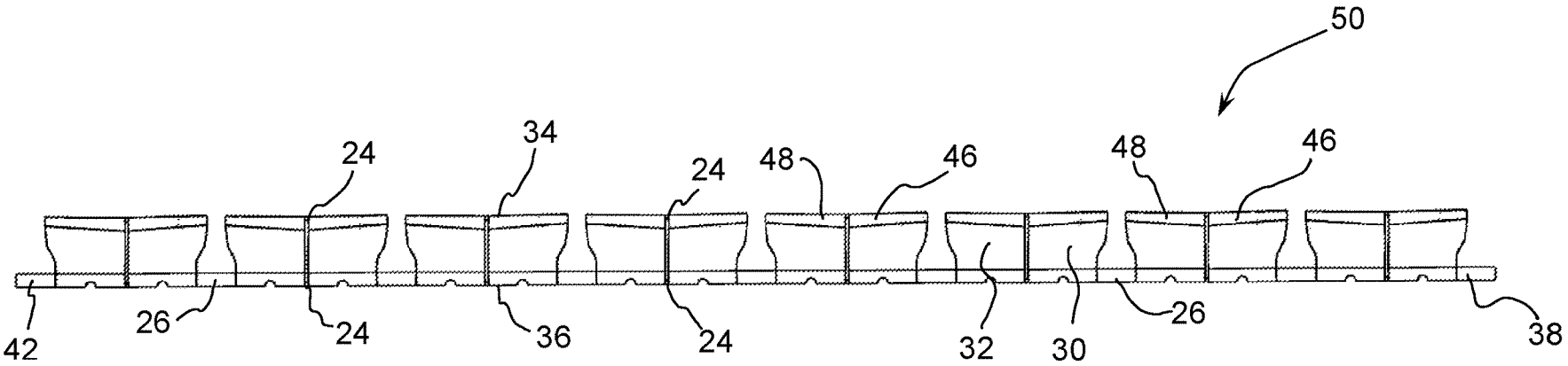
FIG. 4 is a side plan view of a formed strip.
Figure 5:
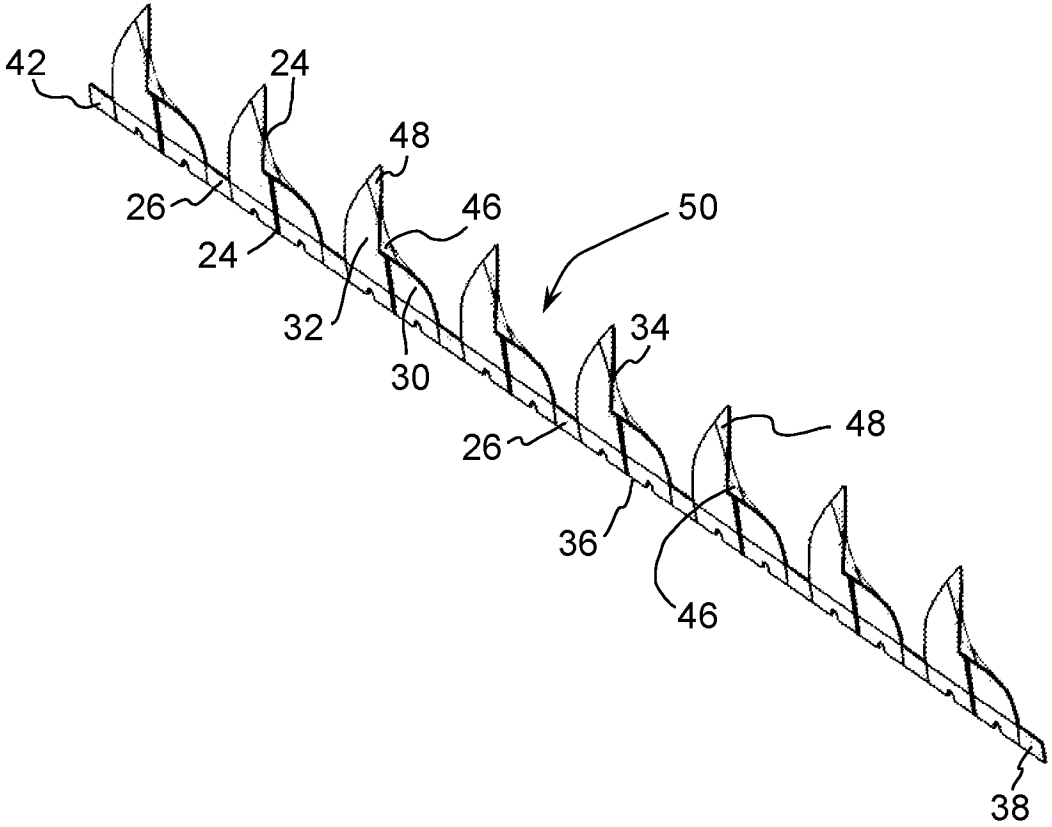
FIG. 5 is a perspective view of the formed strip of FIG. 4.

According to an advantageous embodiment of the invention, the guide blade pairs 28 of the integral flat blank 20 may be acted on with a twisting forming process to bend guide blade pairs 28 to curve each trailing surface 46, 48 of the guide blade pairs 48. The first blade portion 30 and the second guide blade portion 32 of the flat blank 20 are acted on concurrently to twist the first portion trailing surface 46 and the second portion trailing surface 48 with a same directional twist forming operation. This may also be by acting on the first blade portion 30 and the second guide blade portion 32 of the flat blank 20 with a further stamping process. This provides the formed strip 50 as shown in FIGS. 4 and 5.

Figure 6:
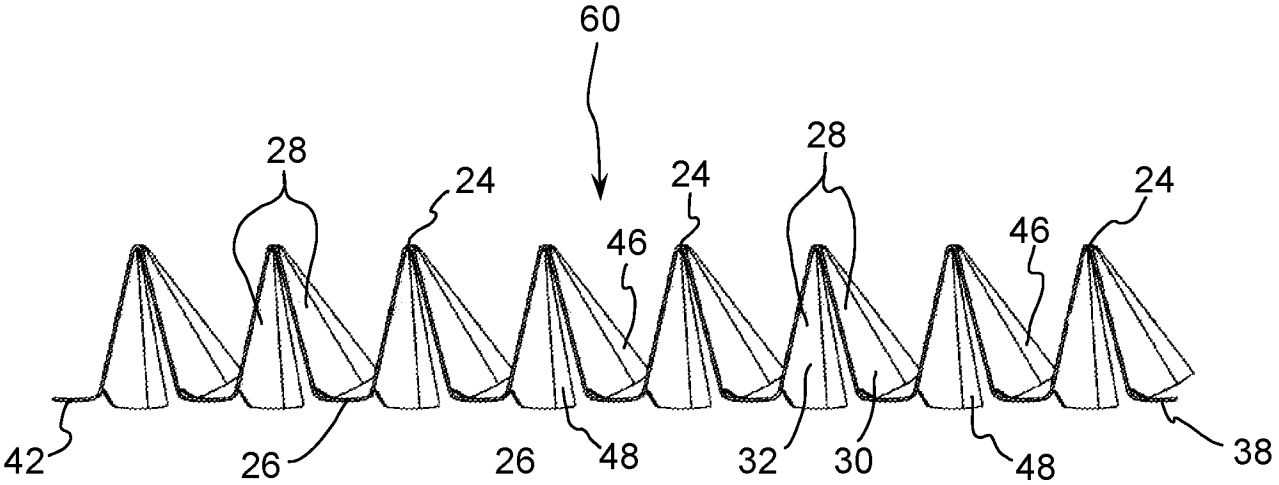
FIG. 6 is a top slightly perspective view of a folded guide blade pairs strip.
Figure 7:
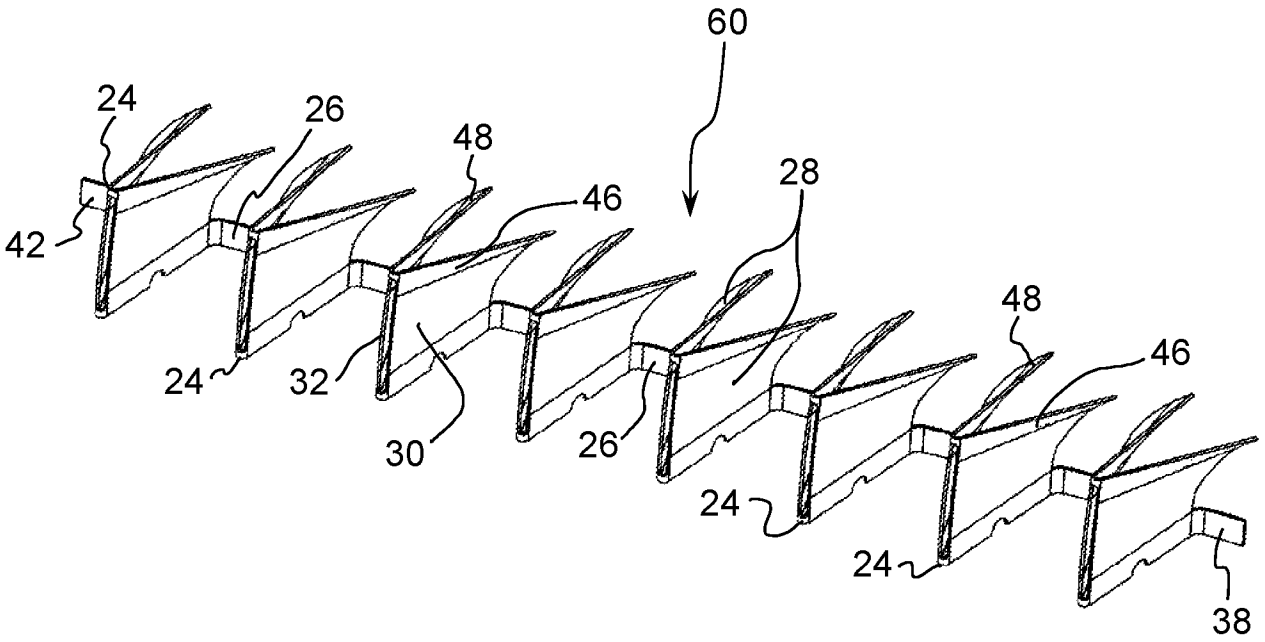
FIG. 7 is a perspective view of the folded guide blade pairs strip of FIG. 6.

Each of the guide blade pairs 28 is folded at the at least one of the fold webs 24 to form a folded strip 60 as shown in FIGS. 6 and 7. If the blades 22 are shaped, curved or bent, the folding occurs subsequent to the forming step. Upon folding, each first blade portion 30 is disposed adjacent to the associated second guide blade portion 32 of each guide blade pair 28. With the forming based on the concurrent twisting of the first portion trailing surface 46 and the second portion trailing surface 48 essentially the same curve and pitch angle are provided for each guide blade 22 of each guide blade pair 28. A stamping of the blades 22 of the flat blank 20 may be used to provide the shaped, curved or bent form. The folding step positions the first blade portion 30 adjacent to the second guide blade portion 32. In the embodiment shown (see FIGS. 6 and 7) the curve of the trailing surface of the first blade portion 30 of a blade pair 28 essentially follows the curve of the trailing surface of the second guide blade portion 32. The first portion curved trailing surface 46 is essentially identical to the second portion curved trailing surface 48. Stamping and forming can be used to provide this and other blade shapes.

Figure 10:
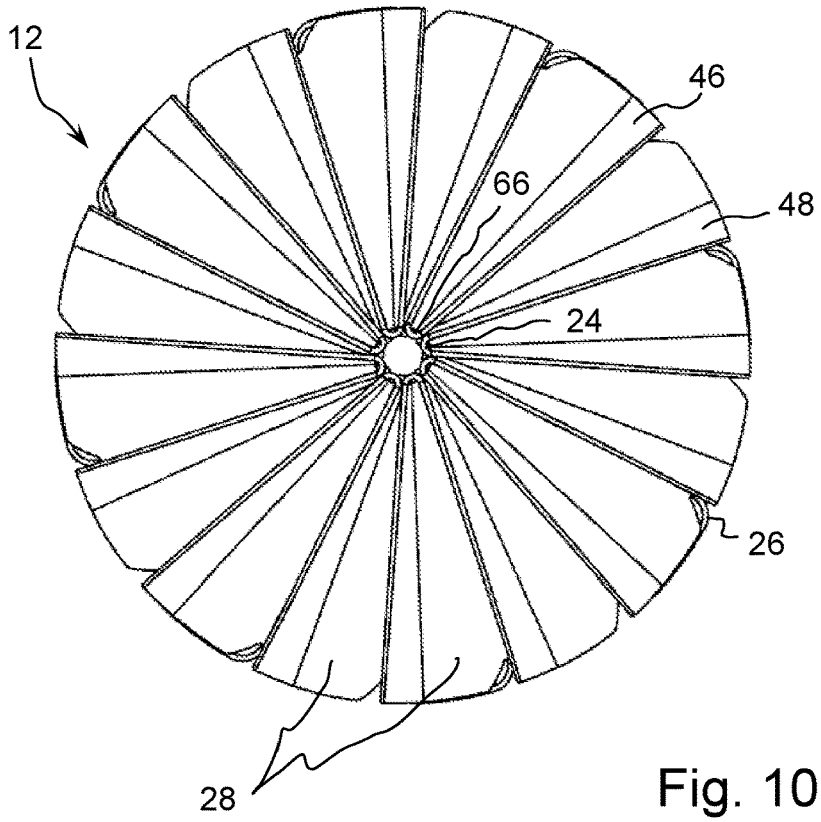
FIG. 10 is an trailing end view showing the trailing end of the mixer of FIG. 8.
Figure 11:
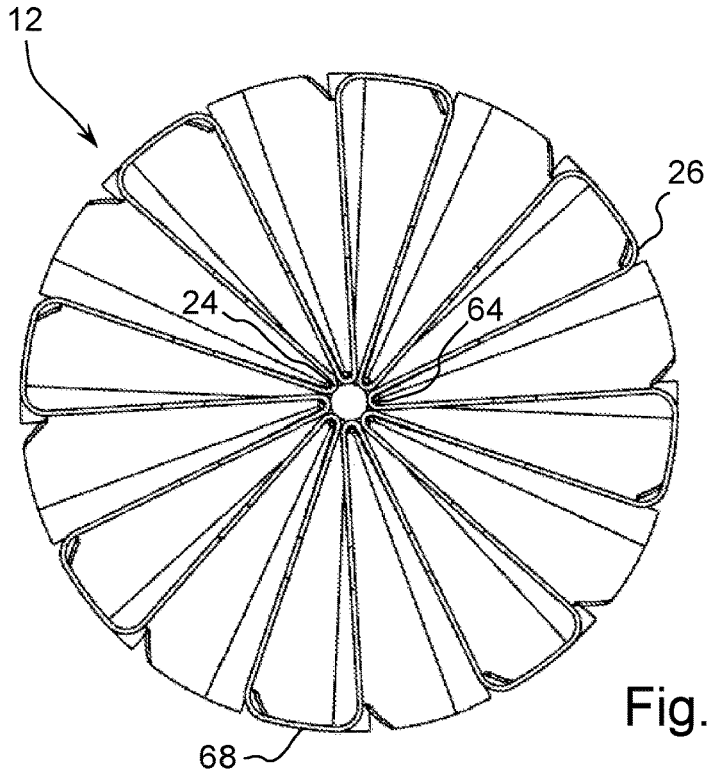
FIG. 11 is a leading end view showing the leading end of the mixer of FIG. 8.
Figure 12:
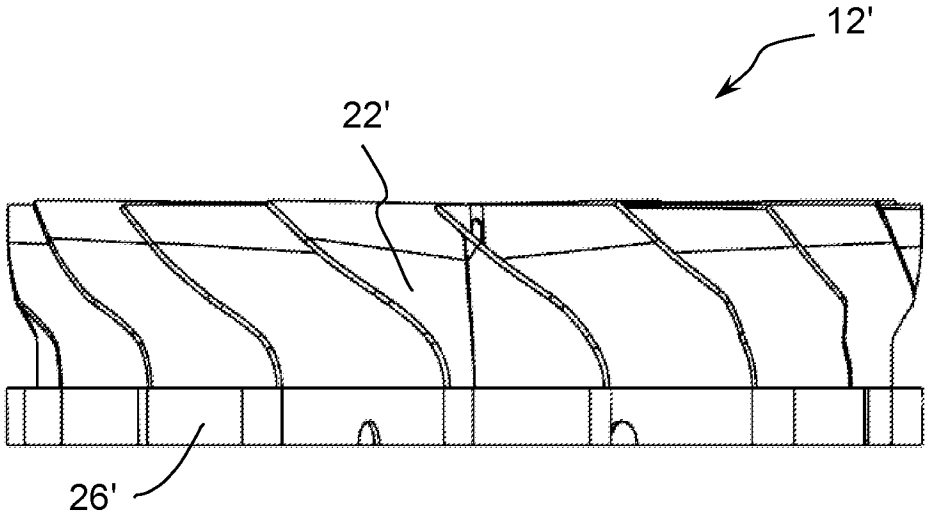
FIG. 12 is a side view of a mixer having a smaller axial dimension and larger circumferential dimension, as compared to the mixer of FIG. 8.

The folded pairs 28 are rolled to form rolled blade pairs 62 having the final shape of the mixer 12 as shown in FIGS. 8-11. The shown blade pairs 28 each have first guide blade portion 30 connected to second guide blade portion 32 by two fold webs 24. One of the fold webs 24 is a leading fold web 24, adjacent to, and shown as forming a part of, the leading edge 36 and a trailing fold web 24 is adjacent to and/or forms a part of the trailing edge 34. With the rolled blade pairs 62 configuration of the mixer 12, a leading edge annular pattern of abutting fold webs 64 is provide (FIG. 11) and a trailing edge annular pattern of abutting fold webs 66 is provided (FIG. 10). In this configuration, the fold webs 24 are disposed centrally and located adjacent to each other in an annular pattern of adjacent fold webs 64. The annular pattern 64 may be provided with each of the fold webs 24 abutting two adjacent fold webs 24. The rolling positions the spacer webs 26 such that they are disposed peripherally spaced apart from each other about a circumference of the mixer 12. This provides an outer peripheral pipe contact surface 68. The dimension and shape of the fold webs 24 may be changed to change the annular pattern 64, in particular to increase or decrease or change the shape of a central passage and to change the flow characteristics of the mixer. Also the number and position of the fold webs may be changed. The tailing fold web 24 may be moved axially away from the trailing edge 34 to allow more of the trailing surface to be angled or curved.

After the rolling of the folded pairs, the mixer 12 may be deployed in an exhaust pipe section of a pipe arrangement 10. The spacer webs 26 form an outer peripheral pipe contact surface 68 that may be fixed to an inner surface of an exhaust pipe. The rolled blade pairs 62 may have some resiliency so that the rolled blade pairs 62 expand slightly upon being inserted into the inner surface of an exhaust pipe. The peripheral pipe contact surface 68 or edges and peripheral regions of the webs 26, may be welded or otherwise fixed to the inner surface of an exhaust pipe after insertion of the rolled blade pairs 62. The fixing may include axial stops that prevent the mixer 12 from axially moving relative to the exhaust pipe. In this case the rolled blade pairs 62 may be retained without any welding or bonding. Further, the first end spacer web segment 38 may be welded or bonded to the second end spacer web segment 42 either before or after the mixer 12 is inserted into the exhaust pipe.

Figure 13:
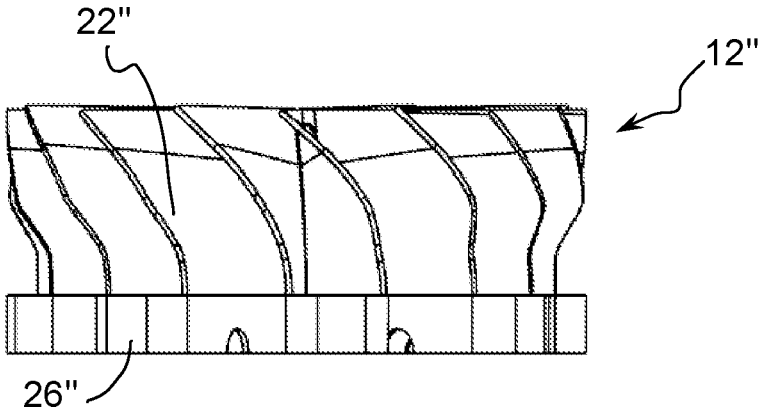
FIG. 13 is a side view of a mixer having a smaller axial dimension and smaller circumferential dimension, as compared to the mixer of FIG. 8.
Figure 14:
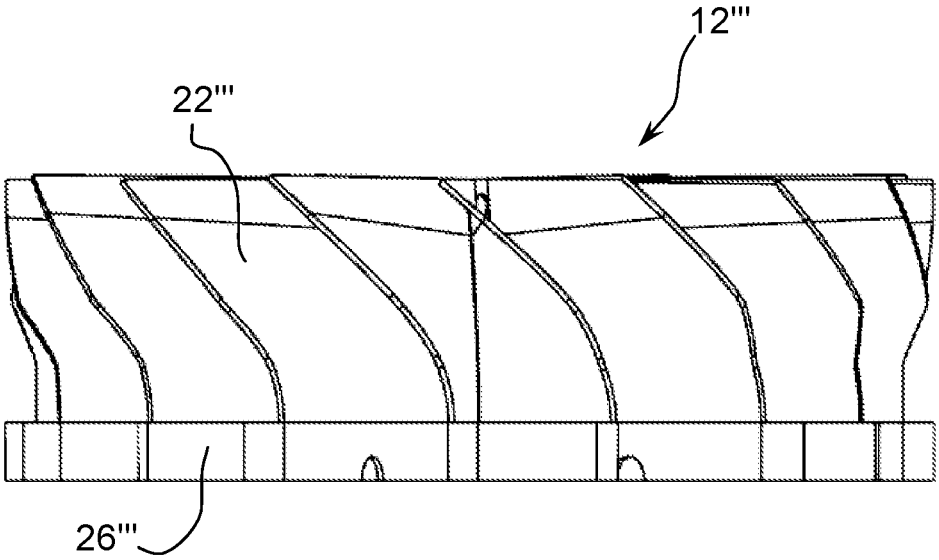
FIG. 14 is a side view of a mixer having a larger axial dimension, as compared to the mixer of FIG. 8.

The configuration with the rolled blade pairs 62 may be used to provide various different sizes, aspect ratios, blade angles and various other modifications. For example, in FIG. 12 a mixer 12' is shown which has much steeper pitch angles for the blades 22'. Further, the mixer 12' has a smaller axial extent (extent in the direction of exhaust gas flow or the direction of the exhaust gas pipe) and has a larger diameter—circumference based on a larger spacing between outer edges of the blades 22' and longer spacer webs 26'. FIG. 13 shows a mixer 12" with blades 22" which have a less steep pitch angle and with a shorter axial extent and smaller circumference based on a larger spacing between outer edges of the blades 22" and longer spacer webs 26". FIG. 14 shows a mixer 12'" with blades 22'" which have a less steep pitch angle as compared to the mixer 12' and with a much longer axial extent and with a circumference that is larger than mixer 12" and smaller than mixer 12'. The dimension of the spacer webs 26 may be changed and this may be done in conjunction with changes to the shape and size of the fold webs 24. The spacing between the trailing edges of the blade groups and the trailing edges of adjacent blade groups is made uniform in the disclosed embodiment, for uniform mixing. However, the spacing between the trailing edges of the blade groups and the trailing edges of adjacent blade groups as well the spacing between trailing edges of the same group as well as the number of blade groups may be adjusted if needed.

For each of the embodiments, the first blade portions 30 and the second guide blade portions 32 of each guide blade pair 28 may, based on plural pairs 28, be treated as a first guide blade group and a second guide blade group. The first guide blade group may have the same pitch angle as the guide blades of the second guide blade group as per the shown embodiments. The axial length of each first blade portion of the guide blade pairs may be essentially the same as the axial length of the second blade portion of the guide blade pairs. However, the pitch angles and other blade attributes may be made different so that the pitch angle or length alternates between the first guide blade group and the second guide blade group. Also the nature of the curved or angled trailing surfaces 46 of the first guide blade group and the second guide blade group may be different. For example, the forming step may twist the first blade portion is 30 more than the second blade portion is 32 or may only act on one of the blade portions 30 or 32, leaving the other without a curved or angled trailing surface 46. One of the guide blade groups may have a flat blade surface. All or some of the guide blades may have a simple flat trailing surface that is bent (angled) relative to the leading blade surface. The curves may each be different or groups of curves/angle bends may be different or the lengths of each blade, or of groups of blades may be different such that the degree of mixing and the action imparted to the exhaust gas is selectively different at different portions of the mixer. This may be used in conjunction with physical attributes of the exhaust system such as bends of exhaust pipes and angles and mounting positions of the of the spray jet 6.

Figure 15:
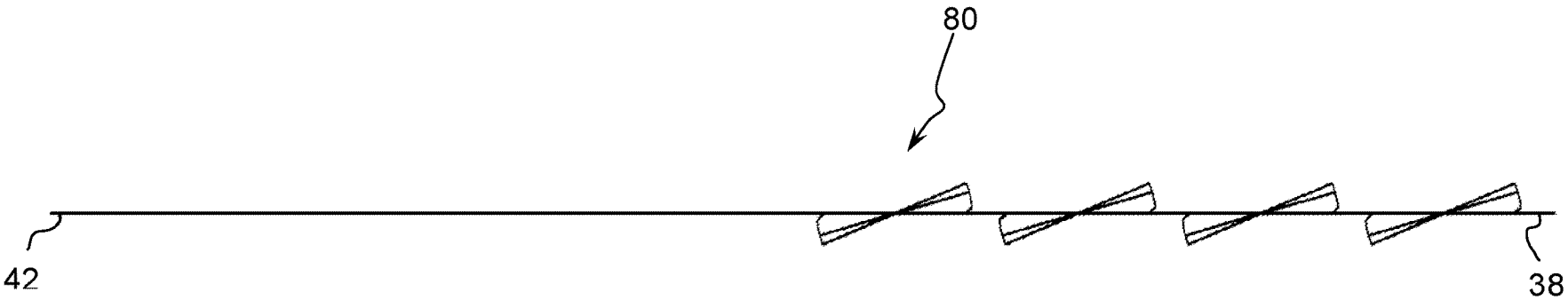
FIG. 15 is a top view of a metal blank/intermediate form with the left portion being flat (following a blank forming stamping process) and the right portion having guide blade pairs formed, such as by further stamping, to provide a bend or curve to the trailing edge surface.
Figure 16:
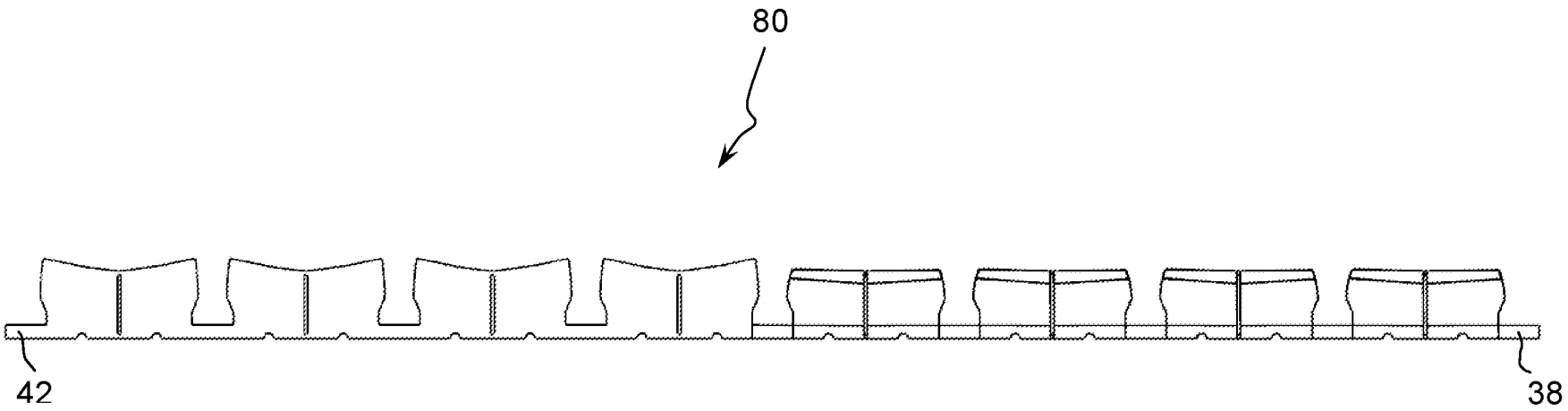
FIG. 16 is a side view of the metal blank/intermediate form of FIG. 15.

FIGS. 15-18 show possibilities with regard to providing multiple processes (method steps) in combination,—combination steps. The configuration and design of the mixer 12, according to the invention, is such that there are several processing options for manufacture. According to one manufacture method embodiment, the sheet metal is blanked to form the blank 20 as shown in FIG. 3 and formed (FIGS. 4 and 5) from a stamping press to form the formed strip 50. The stamping press used to form the formed strip 50 may the same or a different stamping press from the stamping press used to form the blank 20. The formed strip 50 is then placed or fed again in a different stamping press for a different stamping operation to set a form radii and provide the folded strip 60 (FIGS. 6 and 7). The folded strip 60 is then rolled up to produce the rolled blade pair form 62 of the mixer 12. For example, FIG. 15 shows the progression of the method with the intermediate form 80 having a left portion that is flat (following stamping to form the blank 20) and has a right portion that has guide blade pairs formed to provide a bend or curve to the trailing edge surface. This depicts the blanking and forming progression of the intermediate form 80 with a stamping press. This same intermediate form 80 is shown in FIG. 16 (the intermediate form 80 of FIG. 15 is shown in FIG. 16, viewed from the top with reference to FIG. 15). The output of this stamping press operation is the formed strips 50.

Figure 17:
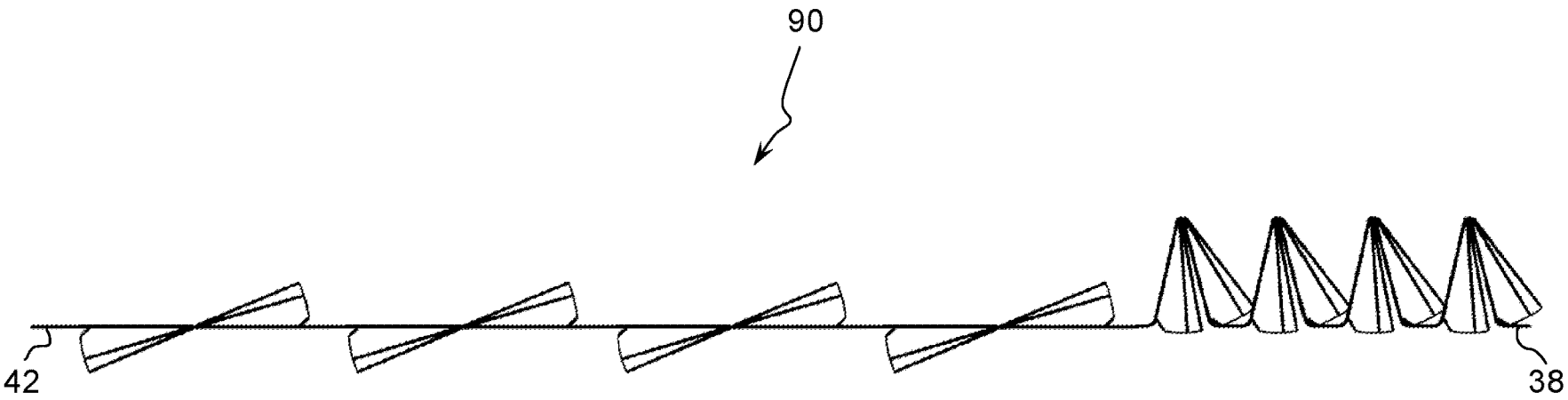
FIG. 17 is a top view of an intermediate form with the left portion having guide blade pairs formed to provide a bend or curve to the trailing edge surface and the right portion having folded guide blade pairs following a forming or roll-forming process.
Figure 18:
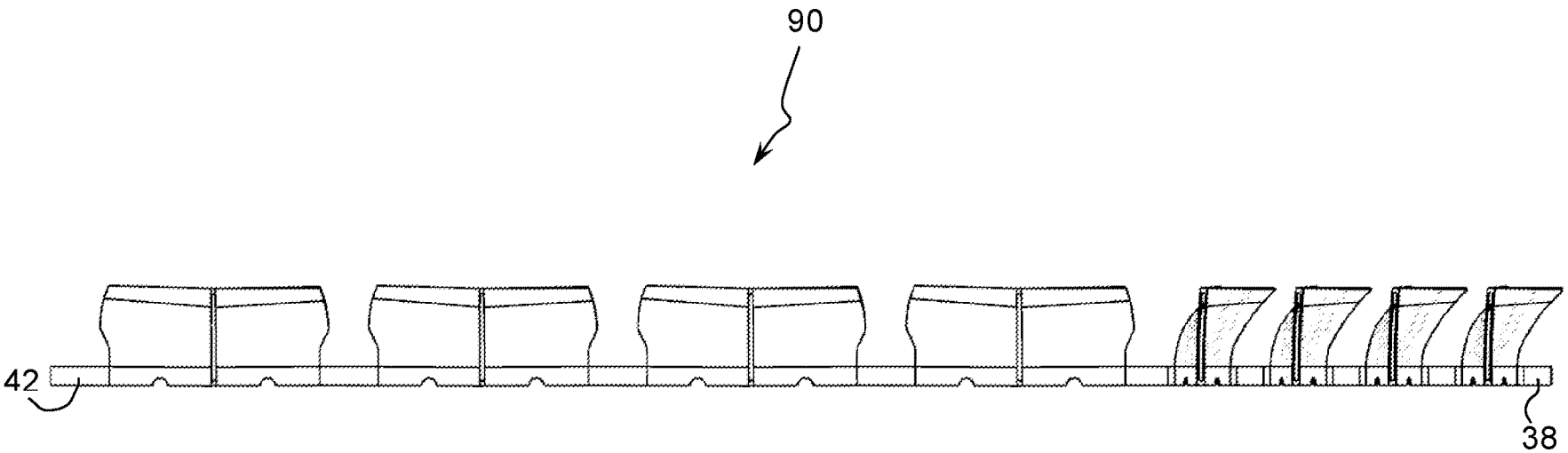
FIG. 18 is a side view of the intermediate form of the middle blank of FIG. 17.

The mixer 12 may also be produced by a form rolling operation by feeding this form rolling operation with formed strips 50. FIG. 17 shows the progression of the intermediate form 90 with a left portion having the configuration of the formed strips 50 and the right portion having passed through the form rolling operation. This intermediate form 90 is shown in FIG. 18 (the intermediate form 90 of FIG. 17 is shown in FIG. 18, viewed from the top with reference to FIG. 17). FIGS. 17 and 18 show a formed strips 50 as the formed strips 50 passes through such a form rolling operation. The advantage to this is that the tooling for such an operation might be much less costly than the tooling for a stamping operation to make the same shape in a press. The configuration and design of the mixer 12, according to the invention, enables either process; typical mixer designs do not.

While specific embodiments of the invention have been shown and described in detail to illustrate the application of the principles of the invention, it will be understood that the invention may be embodied otherwise without departing from such principles.

LIST OF REFERENCE CHARACTERS

| | | | |
|---|---|---|---|
| 1 | exhaust system | 36 | guide blade leading edge |
| 2 | exhaust line | 38 | first end spacer web segment |
| 3 | exhaust gas flow | 40 | first end guide blade pair |
| 4 | SCR catalytic converter | 42 | second end spacer web segment |
| 5 | reactant feeding device | 44 | second end guide blade pair |
| 6 | spray jet | 46 | 1st portion curved or angled trailing surface |
| 7 | oxidation catalytic converter | | |
| 8 | particle filter | 48 | 2nd portion curved or angled trailing surface |
| 9 | SCR catalytic converter coating | | |

-continued

| LIST OF REFERENCE CHARACTERS | | | |
|---|---|---|---|
| 10 | pipe arrangement | 50 | formed blank |
| 11 | injector | 60 | folded blank |
| 12 | mixer | 62 | rolled blade pairs |
| 20 | sheet metal blank | 64 | leading edge annular pattern of abutting fold webs |
| 22 | guide blade portions | | |
| 24 | fold webs | 66 | trailing edge annular pattern of abutting fold webs |
| 26 | spacer webs | | |
| 28 | guide blade pairs | 68 | outer peripheral pipe contact surface |
| 30 | first blade portion | | |
| 32 | second guide blade portion | 80 | intermediate form |
| 34 | guide blade trailing edge | 90 | intermediate form |

What is claimed is:

1. A mixer for an exhaust system of an internal combustion engine for mixing a reactant with an exhaust gas flow, the mixer comprising:

a plurality of guide blade portions;

fold webs, the guide blade portions being provided as guide blade pairs comprising a first blade portion connected to a second guide blade portion by at least one of the fold webs and folded at the at least one of the fold webs such that the first blade portion is disposed extending adjacent to and spaced from the second guide blade portion; and spacer webs, each of the guide blade pairs being connected to at least one adjacent guide blade pair by at least one of the spacer webs, wherein the fold webs are disposed centrally and located adjacent to each other in an annular pattern of adjacent fold webs and the spacer webs are disposed peripherally spaced apart from each other about a circumference of the mixer, wherein:

the guide blade portions, the fold webs and the spacer webs are formed from a single integral flat blank;

the guide blade pairs, comprising the first blade portion connected to the second guide blade portion by the at least one of the fold webs, are separated from adjacent guide blade pairs by one of the spacer webs;

each of the guide blade portions has a trailing edge axially spaced from a leading edge wherein the trailing edge is adjacent to a trailing surface extending at a pitch angle relative to a leading surface adjacent to the leading edge; and the spacer webs are connected to one of the first blade portions of one guide blade pair adjacent to the leading edge thereof and are connected to one of the second blade portions of another guide blade pair adjacent to the leading edge thereof.

2. A mixer in accordance with claim 1, wherein the guide blade pairs of the integral flat blank are acted on with a forming process or stamping process to bend guide blade pairs to curve each trailing surface of the guide blade pairs to provide the pitch angle and the guide blade pairs are subsequently folded at the at least one of the fold webs such that the first blade portion is disposed extending adjacent to the second guide blade portion and the curve of the trailing surface of the first blade portion follows the curve of the trailing surface of the second guide blade portion.

3. A mixer in accordance with claim 2, wherein subsequently to folding the guide blade pairs, the folded guide blade pairs are rolled to form the annular pattern of adjacent fold webs wherein the fold webs each abut an adjacent fold web at one side and abut an adjacent fold web at another side to form the annular pattern as a pattern of abutting fold webs.

4. A mixer in accordance with claim 2, wherein:

the pitch angle of the trailing surface relative to the leading surface of the first blade portion of the guide blade pairs is the same as the angle of the trailing surface relative to the leading surface of the second blade portion of the guide blade pairs; and each trailing edge is axially spaced from each leading edge to define a blade portion axial length and the axial length of the first blade portion of the guide blade pairs is the same as the axial length of the second blade portion of the guide blade pairs.

5. A mixer in accordance with claim 1, wherein:

the spacer webs form an outer peripheral pipe contact surface for engaging an inner surface of an exhaust pipe.

6. A mixer for an exhaust system of an internal combustion engine for mixing a reactant with an exhaust gas flow, the mixer comprising:

a plurality of guide blade portions;

fold webs, the guide blade portions being provided as guide blade pairs comprising a first blade portion connected to a second guide blade portion by at least one of the fold webs and folded at the at least one of the fold webs such that the first blade portion is disposed extending adjacent to and spaced from the second guide blade portion; and spacer webs, each of the guide blade pairs being connected to at least one adjacent guide blade pair by at least one of the spacer webs, wherein the fold webs are disposed centrally and located adjacent to each other in an annular pattern of adjacent fold webs and the spacer webs are disposed peripherally spaced apart from each other about a circumference of the mixer, wherein:

the guide blade portions, the fold webs and the spacer webs are formed from a single integral flat blank;

the guide blade pairs, comprising the first blade portion connected to the second guide blade portion by the at least one of the fold webs, are separated from adjacent guide blade pairs by one of the spacer webs;

each of the guide blade portions has a trailing edge axially spaced from a leading edge; and each of the guide blade portions is connected to another of the guide blade portions of a guide blade pair by two fold webs with a leading fold web adjacent to the leading edge and a trailing fold web adjacent to the trailing edge.

7. A reactant feeding device for an exhaust system of an internal combustion engine, the reactant feeding device comprising:

a pipe arrangement for guiding an exhaust gas flow;

an injector arranged at the pipe arrangement for generating a spray jet from reactant for introduction of the reactant into the exhaust gas flow; and a mixer arranged in the pipe arrangement downstream of the injector in relation of the exhaust gas flow, the mixer comprising:

a plurality of guide blade portions;

fold webs, the guide blade portions being provided as guide blade pairs comprising a first blade portion connected to a second guide blade portion by at least one of the fold webs and folded at the at least one of the fold webs such that the first blade portion is disposed extending adjacent to the second guide blade portion; and spacer webs, each of the guide blade pairs being connected to at least one adjacent guide blade pair by at least one of the spacer webs, wherein the fold webs are disposed centrally and located adjacent to each other in an annular pattern of adjacent fold webs and the spacer webs are disposed peripherally spaced apart from each other about a circumference of the mixer, wherein:

the guide blade portions, the fold webs and the spacer webs are formed from a single integral flat blank; and the guide blade pairs, comprising the first blade portion connected to the second guide blade portion by the at least one of the fold webs, are separated from adjacent guide blade pairs by one of the spacer webs;

the spacer webs are connected to one of the first blade portions of one guide blade pair adjacent to the leading edge thereof and are connected to one of the second blade portions of another guide blade pair adjacent to the leading edge thereof; and the spacer webs form an outer peripheral pipe contact surface for engaging an inner surface of an exhaust pipe.

8. A device in accordance with claim 7, wherein:

each of the guide blade portions has a trailing edge axially spaced from a leading edge wherein the trailing edge is adjacent to a trailing surface extending at a pitch angle relative to a leading surface adjacent to the leading edge.

9. A device in accordance with claim 7, wherein the fold webs each abut an adjacent fold web at one side and abut an adjacent fold web at another side to form the annular pattern as a pattern of abutting fold webs.

10. A device in accordance with claim 7, wherein:

each of the guide blade portions has a trailing edge axially spaced from a leading edge wherein the trailing edge is adjacent to a trailing surface extending at a pitch angle relative to a leading surface adjacent to the leading edge;

the guide blade pairs of the integral flat blank are acted on with a forming process to bend guide blade pairs to curve each trailing surface of the guide blade pairs to provide a pitch angle of a trailing edge relative to a leading edge of each guide blade portion;

the guide blade pairs are folded at the at least one of the fold webs subsequent to forming such that the first blade portion is disposed adjacent to the second guide blade portion and the curve of the trailing surface of the first blade portion follows the curve of the trailing surface of the second guide blade portion; and subsequently to folding the guide blade pairs, the folded guide blade pairs are rolled to form the annular pattern of adjacent fold webs wherein the fold webs each abut an adjacent fold web at one side and abut an adjacent fold web at another side to form the annular pattern as a pattern of abutting fold webs.

* * * * *